US005400909A

United States Patent [19]

Tomat et al.

[11] Patent Number: 5,400,909

[45] Date of Patent: Mar. 28, 1995

[54] DEVICE TO DISCARD SHORT BARS

[75] Inventors: Ferruccio Tomat, Udine; Rolando Paolone, Buttrio; Giuseppe Bordignon, Bicinicco, all of Italy

[73] Assignee: Danieli & C. Officine Meccaniche SpA, Italy

[21] Appl. No.: 277,436

[22] Filed: Jul. 18, 1994

[30] Foreign Application Priority Data

Jul. 29, 1993 [IT] Italy ..... UD93A0146

[51] Int. Cl.[6] ..... B07C 5/14

[52] U.S. Cl. ..... 209/521; 209/620; 209/707; 209/665

[58] Field of Search ..... 209/659, 660, 665, 695, 209/707, 517, 521, 539, 620, 663

[56] References Cited

U.S. PATENT DOCUMENTS

| | | | |
|---|---|---|---|
| 1,499,205 | 6/1924 | Ekström et al. | 209/707 X |
| 2,901,106 | 8/1959 | Aitilen | 209/521 |
| 3,467,253 | 9/1969 | Rossi | 209/521 |
| 3,469,690 | 9/1969 | Ervin | 209/521 |
| 4,143,769 | 3/1979 | Ripple | 209/544 |
| 4,546,886 | 10/1985 | Churchland et al. | 209/665 |
| 4,717,027 | 1/1988 | Laure et al. | 209/620 |
| 4,742,918 | 5/1988 | Doherty | 209/517 |

FOREIGN PATENT DOCUMENTS

| | | |
|---|---|---|
| 518058 | 5/1992 | European Pat. Off. . |
| 3210792 | 11/1982 | Germany . |
| 8707541 | 10/1987 | Germany . |
| 1173641 | 12/1969 | United Kingdom . |

*Primary Examiner*—D. Glenn Dayoan

*Attorney, Agent, or Firm*—Antonelli, Terry, Stout & Kraus

[57] ABSTRACT

Device to discard short bars shorter than a predetermined length from a plurality of bars being fed by feeder that comprise a plurality of first conveyor chains (14*a*) and a matching plurality of second conveyor chains (14*b*), on which the bars (11) are positioned perpendicular to the conveyor chains (14) and are fed in a direction at a right angle to the lengthwise extent of the bars (11), the downstream ends of the first conveyor chains (14*a*) and upstream ends of the second conveyor chains (14*b*) being progressively staggered so as to define a separation channel (13) positioned at an angle to the axis of feed of the bars (11), an angle of between 10° and 45° being defined between the separation channel (13) and the axis of the bars (11), the separation channel (13) cooperating with a bridge to support ends of bars of at least the predetermined length.

4 Claims, 1 Drawing Sheet

DEVICE TO DISCARD SHORT BARS

BACKGROUND OF THE INVENTION

This invention concerns a device to discard short bars.

The device to discard short bars according to the invention is applied advantageously to means which feed bars, such as conveyor chain means for instance, so as to discard bars of a length shorter than a pre-set length.

The state of the art covers the problem of having to discard, from a plurality of bars being fed side by side in a direction at a right angle to the lengthwise extent of the bars on a plurality of conveyor chain means, the bars which are too short to meet the requirements of a pre-determined length.

In fact, the bars which are not of the right length have to be discarded so as to be able to ensure the formation of bundles of bars consisting only of bars having a given minimum length according to the requirements laid down.

The bars which are too short are discarded at the present time by making the plurality of bars travel side by side on a plurality of substantially horizontal conveyor chains which include at a certain point a separation channel having its axis parallel to the axis of the bars being fed and therefore substantially perpendicular to the direction of feed of the bars.

Bridge-type supporting means are included at the separation channel, are fitted suitably spaced apart crosswise and extend by a length enough to straddle the separation channel fully.

The transverse distance between the supporting means is such that the bars longer than the required minimum length rest at their ends on the supporting means, with which are associated chains that carry out the feed of the bars.

The bars which do not reach the pre-set minimum length fall when they arrive at the separation channel, since they are no longer upheld by the conveyor chains or by the lateral supporting means.

But this system entails the problem that the bars which have a suitable length but too small a cross-section and which are supported only at their ends by the supporting means bend at their centre and create problems at the time when they should cooperate with the feeder means positioned downstream of the separation channel.

SUMMARY OF THE INVENTION

The present applicants have designed, tested and embodied this invention so as to overcome the shortcomings of the state of the art and to achieve further advantages.

The device to discard short bars according to the invention enables all bars having a length shorter than a pre-set value to be discarded.

The bars are fed side by side in a direction at the right angle to their lengthwise extent on a plurality of suitably spaced parallel chains.

The device to discard short bars according to the invention consists in the creation of a separation channel of a suitable width to interrupt the chains; the separation channel is arranged diagonally to the direction of feed of the bars.

A bridge-type means cooperates with the interruption channel and can be positioned advantageously in such a way as to define the length of the bars which is to be accepted.

In this way the end of bars shorter than the desired length bends when it is no longer upheld by a chain, and descends below the plane of feed little by little as the bars advance, and finally drops into discharge means positioned below.

Instead, the bars of a length equal to or greater than the length required always stay upheld along almost all their length except for a segment of a short length which remains suspended above the separation channel.

According to a first embodiment supporting arms cooperate with the separation channel and are located substantially below the plane of feed of the bars in cooperation with the separation channel.

These supporting arms have a working position, in which they support the bars which are too short, and a discharge position, in which they release the too short bars which are thus discharged onto removal means consisting, for instance, of an underlying removal roller conveyor.

The actuation of the supporting arms can be timed or be operated by hand by the machine operator.

According to a variant a conveyor belt is included below the separation channel; the short discarded bars fall directly onto this belt and are then discharged onto a removal roller conveyor.

BRIEF DESCRIPTION OF THE DRAWINGS

The attached figures are given as a non-restrictive example and show some preferred embodiments of the invention as follows.

DETAILED DESCRIPTION OF THE PREFERRED EMBODIMENTS

Figure 2:
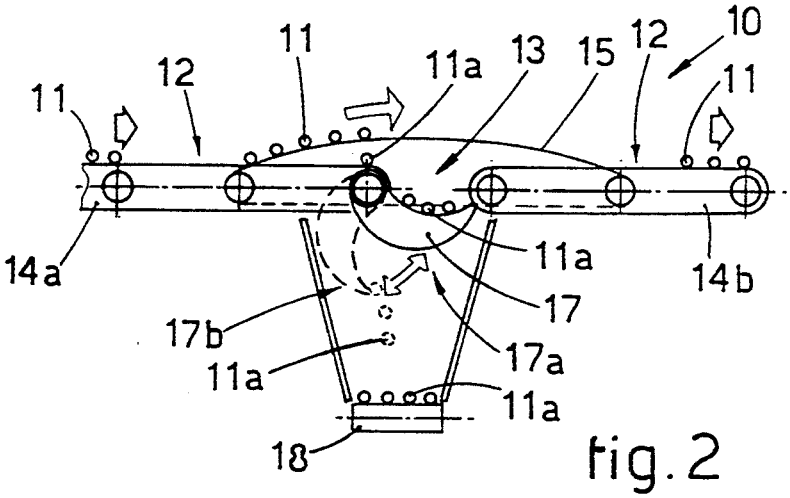
FIG. 2 is a side view in an enlarged scale of the short bar discarding device according to the invention of FIG. 1.
Figure 3:
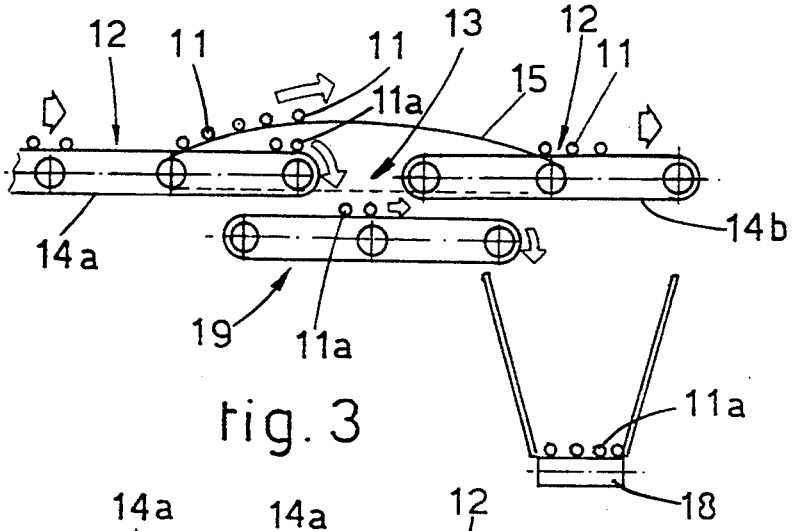
FIG. 3 shows a variant of the device to discard short bars according to the invention as shown in FIG. 2.
Figure 1:
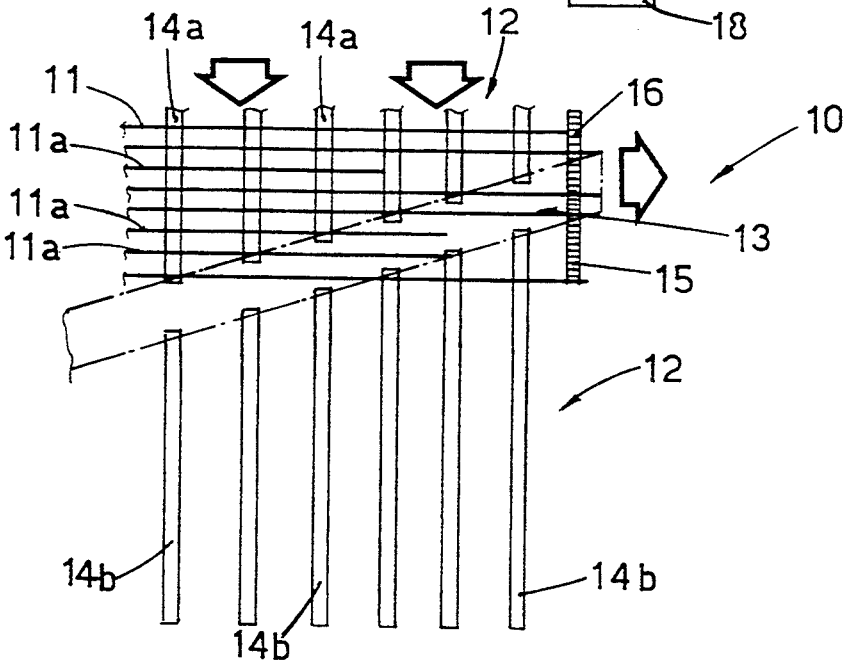
FIG. 1 is a plan diagram of a device to discard short bars according to the invention.

The reference number 10 in the attached figures denotes generally a device to discard short bars 11 according to the invention.

The device 10 according to the invention is applied to a system 12 that feeds single bars 11 lying substantially parallel to each other; these bars 11 are fed in a direction at a right angle to their lengthwise extent.

In this case the feeder system 12 consists of a plurality of first conveyor chains **14*a* positioned parallel and side by side and followed by a coordinated plurality of second conveyor chains 14*b*** which too are parallel to each other.

These pluralities of first **14*a* and second 14*b* conveyor chains are arranged so as to define between them a separation channel 13 positioned diagonally and obtained by staggering in a regular and progressive manner the downstream ends of the first conveyor chains 14*a* and in an analogous manner the upstream ends of the second conveyor chains 14*b***.

The separation channel 13 may be positioned at an angle of 10° to 45° to the axis of the bars 11.

Bridge means 15 which straddle the whole width of the separation channel 13 are positioned at the two ends of that separation channel 13. These bridge means 15 can be positioned advantageously at such a distance apart in a crosswise direction as to define the length of the bars 11 to be accepted.

In this case the bridge means 15 consist of chains 16, which are fed at the same speed as the conveyor chains 14 so as to feed bars 11 of a suitable length continuously from the first conveyor chains 14*a* and to discharge the bars 11 onto the second conveyor chains 14*b*.

The too short bars 11*a* arriving at the separation channel 13, from the moment when their end is no longer upheld by the first conveyor chains 14*a* or by the bridge means 15, descend progressively below the feed plane defined by the conveyor chains 14.

According to a first embodiment of the invention (FIG. 2) the device 10 according to the invention includes a plurality of supporting arms 17 positioned at, and extending over the whole width of, the separation channel 13.

These supporting arms 17 have a first working position 17*a* shown with continuous lines, in which they support short bars 11*a* falling into the separation channel 13, and a second discharge position 17*b* shown with lines of dashes, in which they discharge the short bars 11*a* onto an underlying removal roller conveyor 18.

Actuation of the supporting arms 17 may be timed or be operated by hand by the machine operator.

According to a second form of embodiment an auxiliary conveyor belt 19, onto which the short bars 11*a* fall directly and are then discharged continuously onto the removal roller conveyor 18, is included at the separation channel 13 and below the plane of feed of the bars 11.

We claim:

1. Device to discard short bars which is associated shorter than a predetermined length from a plurality of bars being fed along an axis of feed by a feeder that comprises a plurality of first conveyor chains and a matching plurality of second conveyor chains downstream of said first conveyor chains, the bars being positioned perpendicular to the conveyor chains and being fed in a direction at a right angle to a lengthwise extent of the bars the device being characterised in that downstream ends of the first conveyor chains and upstream ends of the second conveyor chains are progressively staggered so as to define a separation channel positioned at an angle to the axis of feed of the bars an angle of between 10° and 45° being defined between the separation channel and the axis of the bars, the separation channel cooperating with a bridge to support ends of bars having at least said predetermined length.

2. Device as in claim 1, in which the bridge can be moved transversely to define the predetermined length of the bars.

3. Device as in claim 1, in which supporting arms cooperate with the separation channel and have a first working position, in which they support the short bars below a plane on which the bars are supported by said first and second conveyor chains, and a second discharge position for the discharge of the short bars onto a removal roller conveyor.

4. Device as in claim 1, in which an auxiliary conveyor belt for discharge, of short bars onto a removal roller conveyor is provided below said first and second conveyor chains and cooperates with the separation channel.

* * * * *